United States Patent [19]

Kulbida et al.

[11] 4,023,901

[45] May 17, 1977

[54] REPRODUCTION MACHINE SERVICE CONTROL

[75] Inventors: Ihor Kulbida; Robert E. Kalvitis, both of Fairport; Robert C. Hurst, Rochester, all of N.Y.

[73] Assignee: Xerox Corporation, Stamford, Conn.

[22] Filed: Oct. 6, 1975

[21] Appl. No.: 619,760

[52] U.S. Cl. ..... 355/14; 70/182; 355/133

[51] Int. Cl.[2] ..... G03G 15/00

[58] Field of Search ..... 355/17, 3 R, 133, 14; 70/182, 183, 188; 74/813 L, 813 R, 813 C, 815

[56] References Cited

OTHER PUBLICATIONS

IBM Tech. Bull., "Manual Document Advance and Restore," by L. Gravell et al., p. 638, vol. 10, No. 5, Oct. '67.

*Primary Examiner*—Richard L. Moses

[57] ABSTRACT

Control apparatus for a xerographic type copying machine which enables the service technician to give the machine operator or user, as the operator's experience and training progresses, increased control over, and responsibility for, critical machine operating settings. The control apparatus includes a master lock to prevent unauthorized tampering with the machine settings by anyone except the authorized service technician. Individual locks, accessible only to the service technician, are provided for controls which it is expected that the operator or user, with training and experience, can ultimately handle. To nevertheless restrict and control the degree of operator responsibility and involvement in adjusting machine operating settings, means are provided with each control to enable the amount of adjustment that can be made limited.

5 Claims, 7 Drawing Figures

REPRODUCTION MACHINE SERVICE CONTROL

This invention relates to electrostatic type reproduction machines, and more particularly to an improved method and apparatus for servicing such machines.

High speed copiers and duplicators are relatively complex machines, and normally include a variety of controls accessible to the trained and highly skilled service technician for adjusting and optimizing machine performance. These may include voltage and current adjustments to various operating components dependent upon such voltage and current inputs for effective operation.

Since adjustments to the machine operating components are both critical and often interrelated, it is normally desired that such adjustments be reserved for the trained technician and that others be precluded from making such adjustments. At the same time, it is recognized that a dedicated machine user or operator may, with sufficient experience and instruction, be capable of making certain adjustments herself without the need to call upon and wait for the trained technician. Notwithstanding, protection against unauthorized adjustments by others is still necessary, and even against over adjustment by the dedicated operator.

It is therefore a principal object of the present invention to provide a new and improved electrostatic type reproduction machine.

It is a further object of the present invention to provide improved method and apparatus for servicing copiers.

It is an object of the present invention to provide an improved system for adjusting the operating components of a reproduction machine.

It is an object of the present invention to provide an arrangement which allows responsibility for making servicing adjustments to a xerographic type reproduction machine to be increasingly shared by the machine operator as the operator's experience and familiarity with the machine increases.

It is an object of the present invention to provide an improved method and apparatus for servicing an electrostatic reproduction machine in which the machine operator is allowed to assume an increasing burden for servicing the machine with correspondingly less burden for the machine service technician.

It is an object of the present invention to provide for a copier service module or modules, an arrangement to prevent unauthorized meddling with the service module yet enable by degrees, responsibilities for making critical copier settings to be released to the non-technically trained copier user as the user becomes more familiar with the copier.

This invention relates to a method of operating a xerographic reproduction machine having a plurality of discrete operating components cooperable to produce copies with at least one of the components being adjustable to permit the operating parameters thereof to be varied, the steps comprising: presetting the one operating component to a predetermined operating level; enabling the setting of the one machine operating component to be varied within preset limits by the machine user; and setting a master lock to prevent tampering with the machine operating component setting except to the extend enabled.

This invention further relates to a xerographic type reproduction machine having plural operating components, comprising, in combination: adjusting means associated with each of the machine operating components to enable the working setting of each component to be changed when servicing the machine to provide optimum machine performance; at least one of the individual adjusting means including reset control means adapted when actuated to permit the setting of the component associated therewith to be changed within predetermined limits by the machine user between machine servicing intervals; and master lock means effective when set to prevent unauthorized actuation of the component adjusting means and changing of the component settings except within the predetermined limits permitted by actuation of the reset control means.

Other objects will be apparent from the ensuing description and drawings in which.

Figure 1:
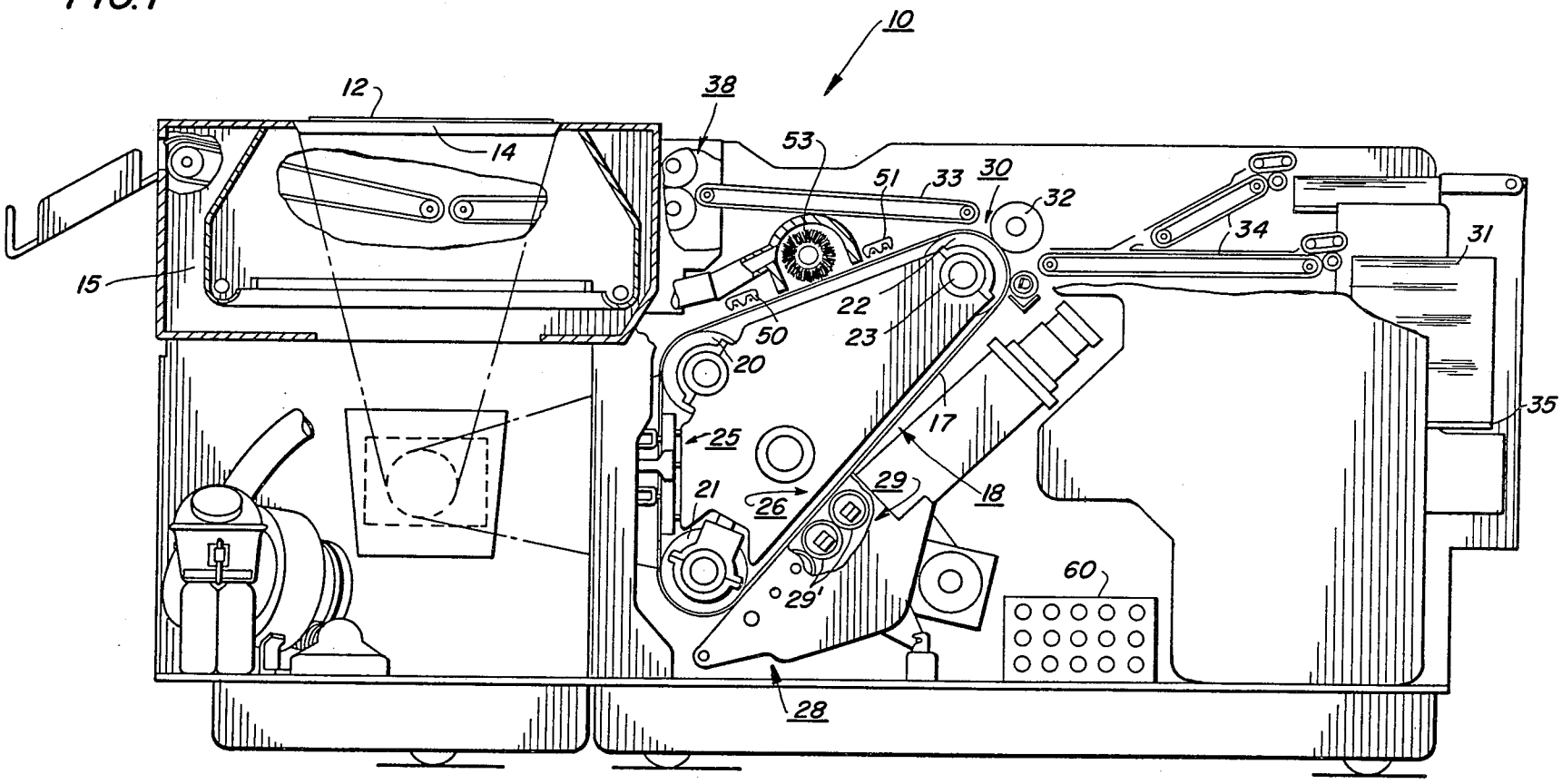
FIG. 1 is a schematic view of an exemplary electrostatic reproduction machine incorporating the control knob of the present invention.

Referring particularly to FIG. 1 of the drawings, an exemplary copier/reproduction machine designated generally by the numeral 10 and incorporating the control arrangement of the present invention is there shown. As in all electrostatic systems such as the xerographic type machine illustrated, a light image of a document to be reproduced is projected onto the sensitized surface of a xerographic plate to form an electrostatic latent image thereon. Thereafter, the latent image is developed with an oppositely charged developing material to form a xerographic powder or toner image, corresponding to the latent image on the plate surface. The toner image is then electrostatically transferred to a support surface where it is fused by a fusing device so that the toner image is permanently adhered to the support surface.

In machine 10, an original document 12 to be copied is placed upon a transparent support platen 14 fixedly arranged in an illumination assembly generally indicated by the reference numeral 15 and disposed at the left end of the machine. While upon the platen, the document 12 is illuminated, thereby producing image rays corresponding to the informational areas on the original. The image rays are projected by means of an optical system onto the photosensitive surface of a xerographic plate. In the exemplary copier/reproduction machine 10, the xerographic plate is in the form of a flexible photoconductive belt 17 supported in a belt assembly 18.

The support assembly 18 for photoconductive belt 17 includes three rollers 20, 21 and 22 located with parallel axes at approximately the apices of a triangle. The upper roller 22 is rotatably supported on shaft 23 which in turn is rotatably driven by a suitable motor and drive means (not shown) to drive belt 17 in the direction shown by the arrow in FIG. 1. During this movement of the belt, the reflected light image of the original document 12 on platen 14 is flashed upon the photoreceptor surface of belt 17 at an exposure station 25 to produce an electrostatic latent image thereon.

The continued movement of photoconductive belt 17 carries the electrostatic image through a developing station 26 in which there is positioned a developer assembly generally indicated by the reference numeral 28. There the latent electrostatic image is developed by means of toner through the use of a multiple magnetic brush system 29.

The developed electrostatic image is carried by belt 17 to the transfer station 30 where the developed image is transferred to a support surface, normally a sheet of copy paper 31, brought forward between transfer roller 32 and belt 17. To accomplish transfer of the developed image, an electrical bias is applied to transfer roller 32. Copy sheet 31 is moved at substantially the same speed as belt 17. A sheet transport mechanism generally indicated at 34 is provided to advance copy sheets 31 from a paper handling mechanism generally indicated by the reference numeral 35 to transfer station 30.

Following transfer, the copy sheet 31 is separated from belt 17 and conveyed by transport 33 to fuser 38 wherein the toner image is permanently fixed or affixed thereto. Following fusing, the finished copy may be discharged directly to a copy collecting device such as an output tray or sorter (not shown).

Photoconductive belt 17 comprises a photoconductive layer of selenium, which is the light receiving surface and imaging medium for the apparatus on a conductive backing. Further details regarding the structure of the belt assembly 18 and its relationship with the machine and support therefor may be found in U.S. Pat. No. 3,730,623, issued May 1, 1973.

Reproduction machine 10 includes a suitable corona discharge device, i.e., corotron 50 for uniformly charging photoconductive belt 17 preparatory to exposure thereof at imaging station 25. A second corona discharge device, preclean corotron 51 is provided upstream of belt cleaning brush 53 to facilitate removal of leftover developing materials therefrom. A suitable source of electrical energy (not shown) is provided for corotrons 50, 51.

The enhance development of the latent electrostatic images produced on belt 17 by magnetic brushes 29, suitable electrical bias may be applied to the exterior sleeves 29' of brushes 29. To enhance transfer of the developed image from belt 17 to copy sheet 31 at transfer station 30, a suitable electrical bias may be applied to transfer roller 32. A suitable source of electrical bias is provided for magnetic brushes 29 and transfer roller 32.

In addition to the machine components described above, various other operating components, i.e., automatic developability controls, may utilize electrical power and energy to enhance operation thereof. As will be understood by those skilled in the art, the power and bias settings of the various operating components such as corotrons 50, 51 and magnetic brushes 29 may be critical to the attaining of optimized machine operation.

To enable operation of reproduction machine 10 to be optimized, some or all of the machine operating components made adjustable to permit the settings thereof to be changed from time to time during the service life of reproduction machine 10. While adjustments in the settings of the various operating components must normally be made by a highly trained service technician rather than the machine operator, or user. It can be understood that skilled operators may, in some cases be relied upon to make at least limited adjustments in the settings of some or all of the machine operating components.

Figure 2:
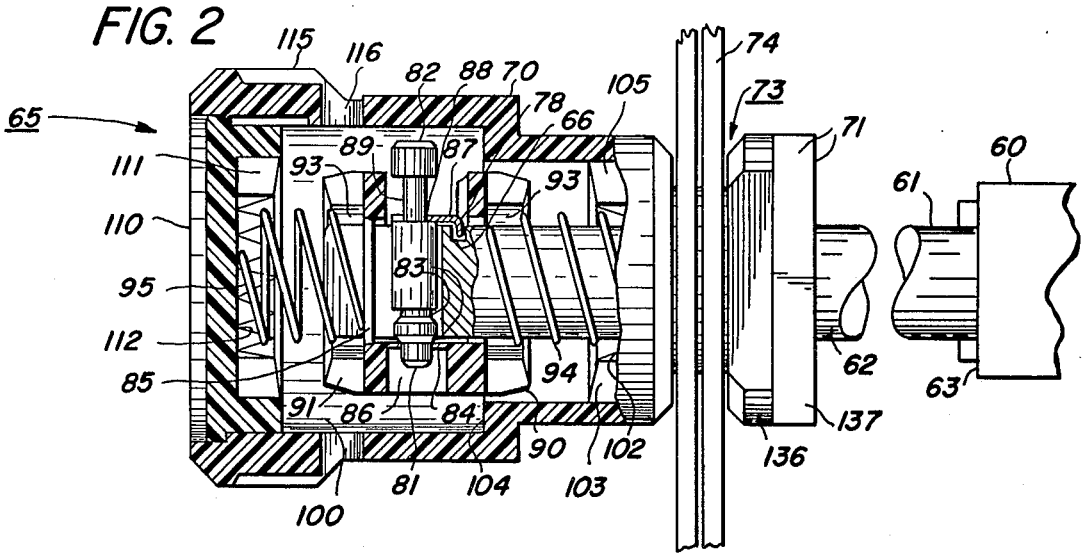
FIG. 2 is a side view in cross section showing the control knob of the present invention in a locked state.

Referring now to FIGS. 2 of the drawings, a machine service module designated by the numeral 60 is there shown. For purposes of explanation, service module 60 is presumed to include the source of electrical bias to magnetic brushes 29 although it will be understood that service module 60 provides service access to various other machine components as well. Bias adjusting shaft 61 projects from side 63 of power source 60, shaft 61 serving to regulate the bias applied to magnetic brushes 29. To permit limited or restricted access to shaft 61, a lockable control knob 65 is provided. As will appear, control knob 65, under certain conditions, permits either free or restricted rotation of shaft 61 and adjustment of the bias output of power source 60 depending on the condition of the locking means.

Control knob 65 comprises a generally cylindrical outer sleeve 70 slidably and rotatably received on the projecting terminal end 62 of the bias adjusting shaft 61. For this purpose, the interior dimension of the inside end 71 of sleeve 70 within which the shaft end 62 is received, is slightly larger than the outer dimension of the shaft end. The outer periphery of sleeve 70 is slotted at 73 for cooperation with locking plate 74 as will appear more fully hereinbelow.

A cylindrical clutch collar 80 is non-rotatably mounted on the terminal end 62 of bias adjusting shaft 61 by means of pin 81 and interior web 85. Pin 81 acts as a guide for the trailing web 85 on insertion of clutch collar 80 onto the end 62 of shaft 61, the shaft terminal end 62 being slotted at 64 for receipt of pin 81 and web 85 therewithin. Clutch collar 80 is provided with a hole 86 for receipt of pin 81, the axis of hole 86 paralleling the axis of internal web 85. As will appear, head portion 82 of pin 81 also functions as a stop with pin 81 being arranged for limited displacement in an axial direction to move stop 82 to an inoperative position. For this purpose, pin 81 is recessed at 83 adjacent one end, recesses 83 cooperating with spring elements 84 integral with collar 80 to form a spring detent designed to retain pin 81 in either a raised position (the position of FIG. 3) or a depressed position (the position of FIG. 4).

To prevent movement of clutch collar 80 in a longitudinal direction and retain pin 81 in collar 80, a spring retainer 87 is provided. Retainer 87 is provided with a depending prong 78 adapted when clutch collar 80 is fully seated on adjusting shaft 61, to enter slot-like recess 66 in the exterior of shaft 61. Notch 88 in retainer 87 cooperates with reduced diameter area 89 of pin 81 to limit axial movement of pin 81 to a preset amount. It is understood that the degree of axial movement allowed pin 81 by retainer 87 is sufficient to accommodate movement of pin 81 between a raised position (shown in FIG. 3) or depressed position (shown in FIG. 4).

To release retainer 87 when it is desired to withdraw clutch collar 80 from adjusting shaft 61, pin 81 is raised upwardly against the bias imposed by retainer 87 to lift prong 78 of retainer 87 from recess 66 of shaft 61. With prong 78 released, collar 80 may be withdrawn from the terminal end 62 of adjusting shaft 61, web 85 and pin 81 sliding within slot 64 of adjusting shaft 61. The relative dimensions of web 61 and slot 64 are such that web 85 fits snugly within slot 64 of shaft 61.

Clutch collar 80 has clutch faces in the form of beveled gear teeth 90, 91 formed on each end thereof. The end portions of collar 80 are recessed at 93 to accommodate sleeve locating springs 94, 95.

The interior 100 of sleeve 80 is of sufficient diameter to accommodate clutch collar 80 and axial movement of pin 81 between pin raised and lowered positions The interior dimension of sleeve 70 is progressively stepped at 102, 103 and 104 to form, respectively a locating recess for spring 94, a clutch face in the form of gear teeth 105 matable with gear teeth 90 of clutch collar 80, and a stop abutment cooperable with head 82 of pin 81 to restrict axial motion of sleeve 70 as will appear. See FIG. 3.

A cylindrical end cap 110 having an interior clutch surface in the form of beveled gear teeth 111, matable with gear teeth 91 of clutch collar 80 as will appear, is suitably attached to the open end of sleeve 70 to close the sleeve end. A locating recess 112 in cap 110 serves to receive and locate spring 95.

A portion 115 of the exterior surface of sleeve 70 may be knurled to facilitate grasping thereof by the user. An access hole 116 is provided in sleeve 70 for pin 81, the position of access hole 116 being such that in the normal position of sleeve 70 (shown in FIG. 2), pin 81 is inaccessible.

Figure 6:
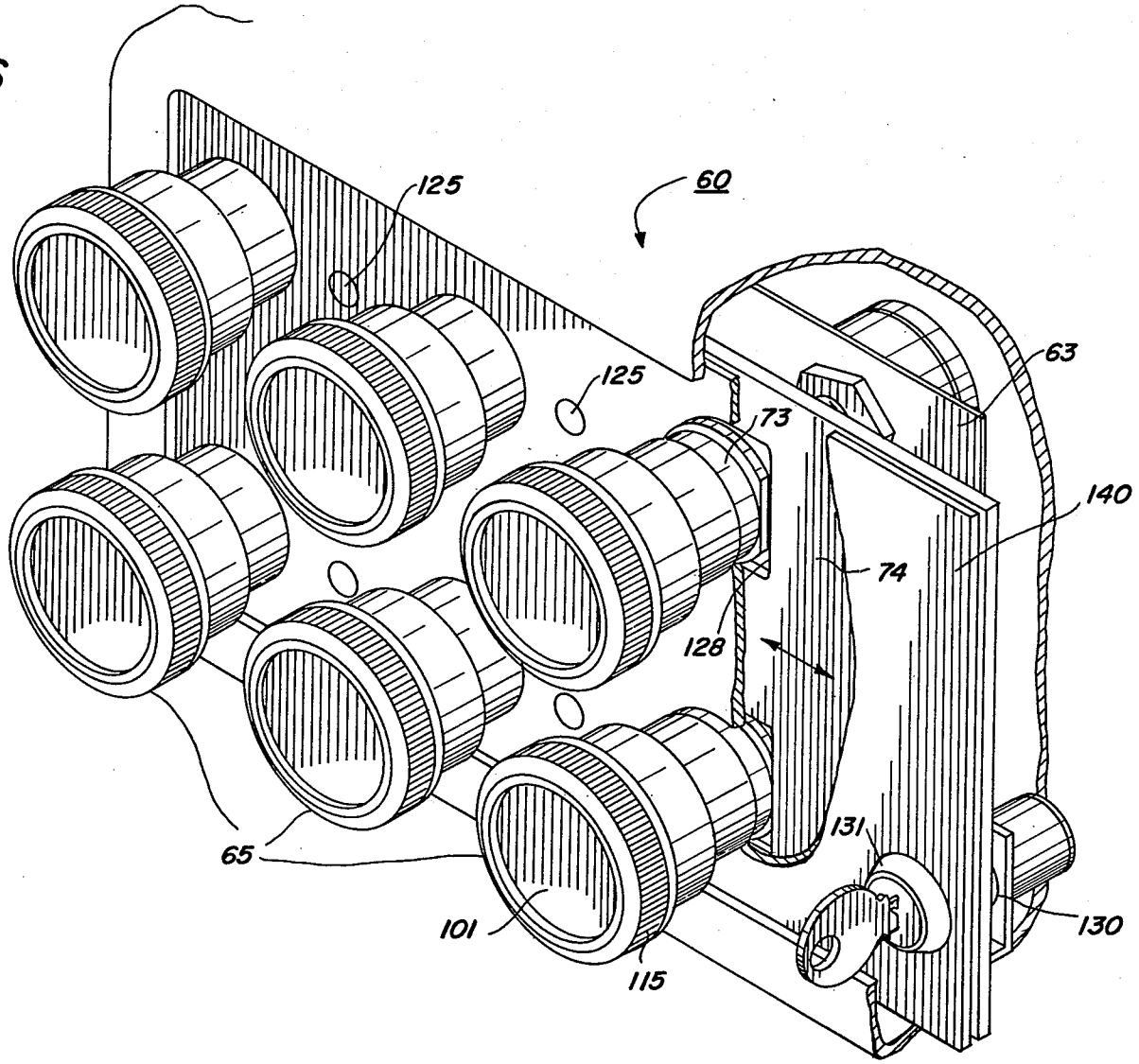
FIG. 6 is an isometric view illustrating the locking plate details.
Figure 7:
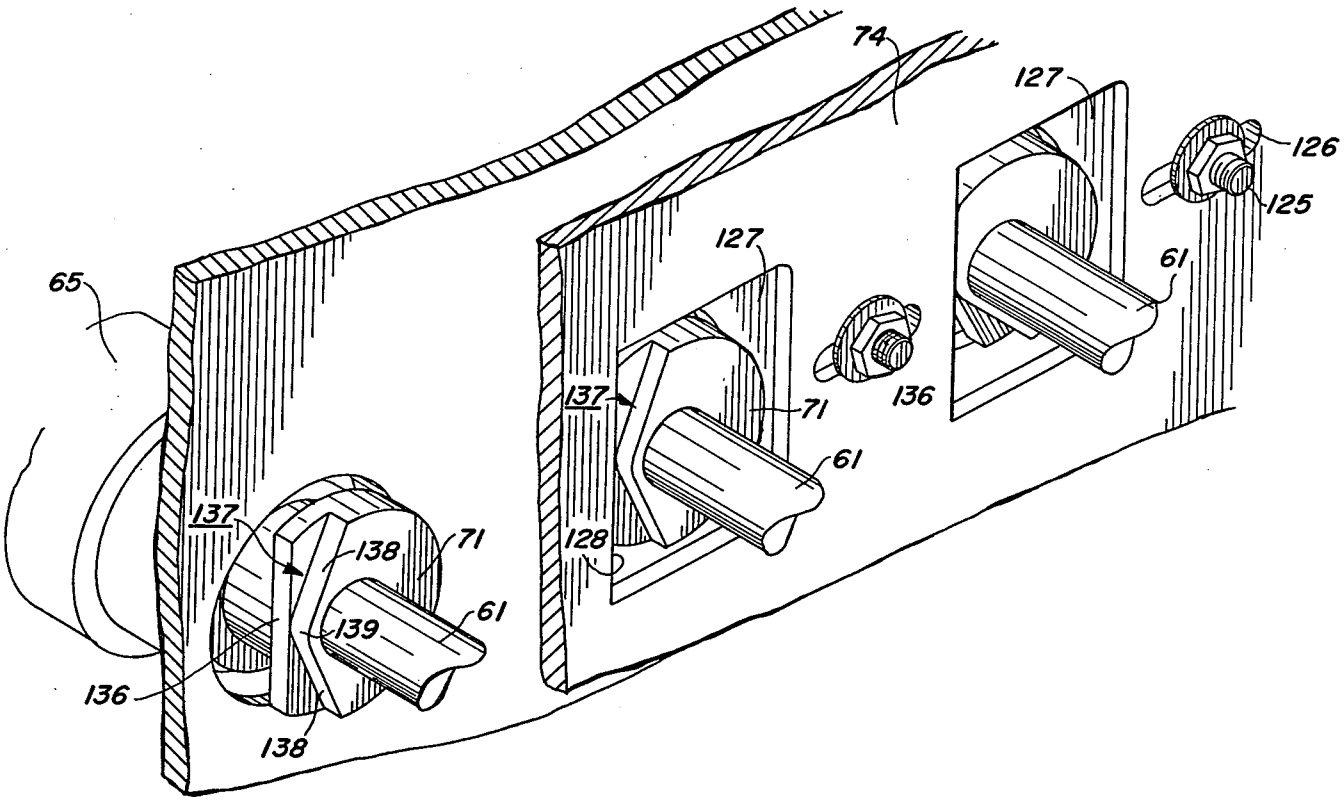
FIG. 7 is an isometric view showing the locking plate and the relationship thereof to the control knob in various operating dispositions.

Referring particularly to FIGS. 6 and 7 locking plate 74, which cooperates with recess 73 in the periphery of the control knob sleeve 70 to prevent or restrict operation of control knob 70 as will appear, comprise a generally rectangular plate-like part supported for sliding motion by cooperating pin 125 and slot 126 means. Pins 125, which may conveniently comprise screw elements 125, are carried on an underlaying frame member 140 while slots 126 are provided in locking plate 74.

Plate 74 is apertured at 127 to accommodate control knob 65, it being understood that the number of apertures 127 in plate 74 and the aperture position correspond to the number and position of control knobs 65 in a multiple control knob arrangement. Aperture 127 in plate 74 comprises a rectangular shaped opening with side 128. The dimension of aperture 127 is slightly larger than the outside diameter of sleeve end 71 to permit control knob 65 to be reciprocated back and forth freely on displacement of plate 74 to the unlocked position.

A suitable lock which may comprise an eccentric driver 130 with key lock 131 is provided to restrict displacement of locking plate 74 and use of control knob 65 to authorized persons.

Peripheral recess 73 in control knob sleeve 70 is relatively wide. Sleeve end 71 has a D-shaped section 136 and a triangular shaped section 137, the latter being comprised of two flat surfaces 138 intersecting at apex 139. When disposed within aperture 127 of locking plate 74, triangular section 137 permits limited rotation of control knob 65 through a predetermined arc as determined by the configuration of section 137.

In use, where adjustment of the machine operating component represented by shaft 61 is restricted to the trained service technician, control knob 65 is locked against operation through the interengagement of locking plate 74 with recessed section 73. In this disposition, locking plate 74 is disposed so that one side 128 of aperture 127 projects into recess 73. This prevents sleeve 70 of control knob 65 from being moved axially, either through pushing or pulling of the control knob a distance sufficient to engage gear set 90, 105, or gear set 91, 111. Thus, while control knob 65 can be freely rotated, no rotation will be imparted to the bias adjusting shaft 61.

While the control knob sleeve 70 might, due to the presence of adjoining recess sections 136, 137 otherwise be pulled outwardly in a direction which would ordinarily bring gear set 90, 105 into meshing engagement, interengagement of the projecting head 82 of pin 81 with internal stop 104 on sleeve 70 inhibits the degree of sleeve movement to a point where meshing of gear set 90, 105 cannot be obtained. This is shown in See FIG. 3.

When the machine service technician wishes to adjust the setting of the bias power supply 60, lock 131 is unlocked by means of a key in the technician's possession. With lock 131 free, locking plate 74 may be shifted axially to bring the enlarged portion of the aperture or apertures 127 in plate 74 into substantial alignment with the control knob or knobs 65. This permits the control knob sleeve 70 to be depressed against the bias of spring 95 to engage gear set 91, 111. With gear set 91, 111 held in engagement, control knob 65 may be rotated either clockwise or counterclockwise as appropriate to turn the control shaft 61 and adjust the bias level associated therewith. Control knob 65 is then released. When adjustments are completed, locking plate 74 returned to the control knob locking position.

When it is felt that the machine operator is ready to make limited adjustments to one or more of the machine operating components, the service technician may, during a service period when plate 74 is unlocked, align the access hole 116 in control knob sleeve 70 with pin head 82. Then, by means of a driving device, such as an allen wrench, the technician may depress pin 81 to the second detent position formed by the uppermost recess 83 and resilient projections 84. (See FIG. 4) The control knob 65 may then be released and the locking plate 74 returned to the control knob locking position and lock 131 re-locked.

In the event the machine operator wishes to make adjustments, the control knob 65 is turned to bring the flattened portion of the D-shaped section 136 into alignment with the side 128 of aperture 127 in locking plate 74. Knob 65 may then be drawn or pulled outwardly against the bias of spring 94 to engage gear set 90, 105. At the same time, as control knob 65 is pulled out to engage gear set 90, 105, the triangular shaped section 137 to sleeve 70 is brought within aperture 127 in plate 74 and opposite side 128 thereof. This disposition of the control knob sleeve 70 restricts the degree of permissable rotation of control knob 65 to the arc defined by the triangular section 138. Thus while control knob 65 may be drivingly coupled to shaft 61, the arc through which shaft 61 may be turned, and hence the degree of adjustment that may be made to the specific machine operating component associated with the control knob by the operator is limited.

Figure 3:
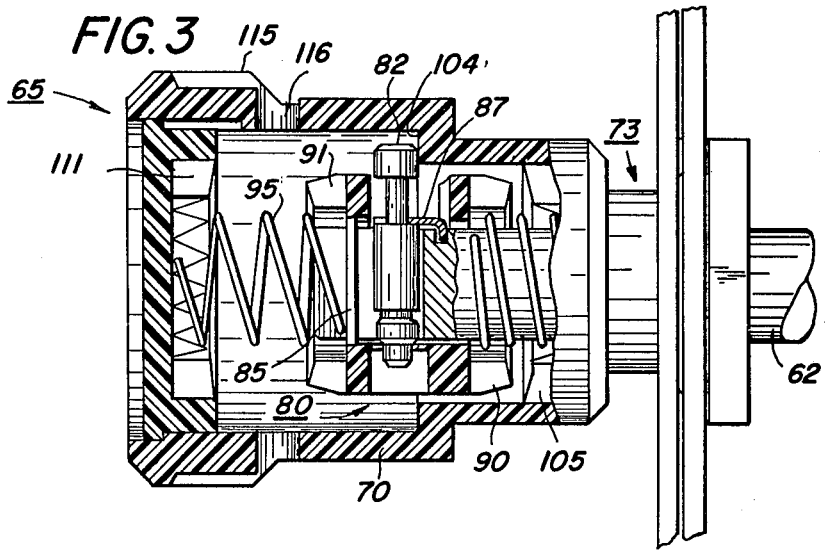
FIG. 3 is a side view in cross-section showing the control knob pulled with the stop raised to prevent engagement of the drive clutch.
Figure 4:
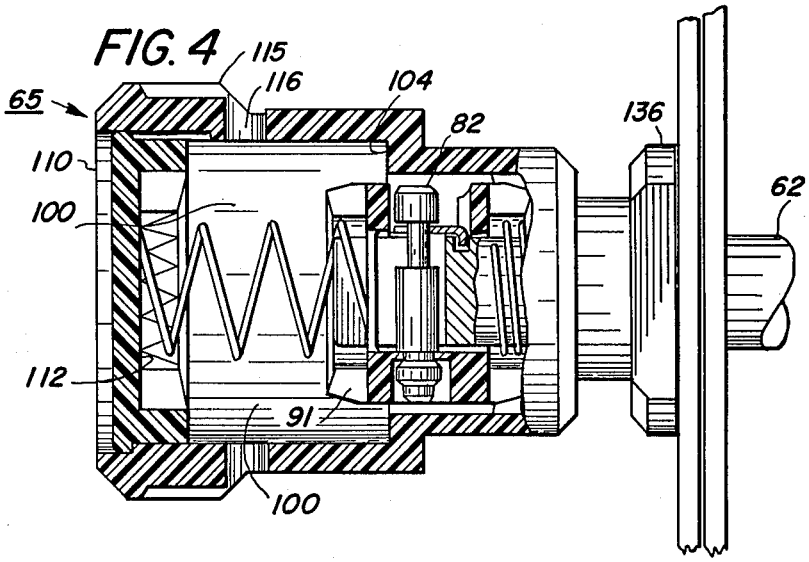
FIG. 4 is a side view in cross-section showing the control knob pulled with the stop depressed to permit engagement of the drive clutch.
Figure 5:
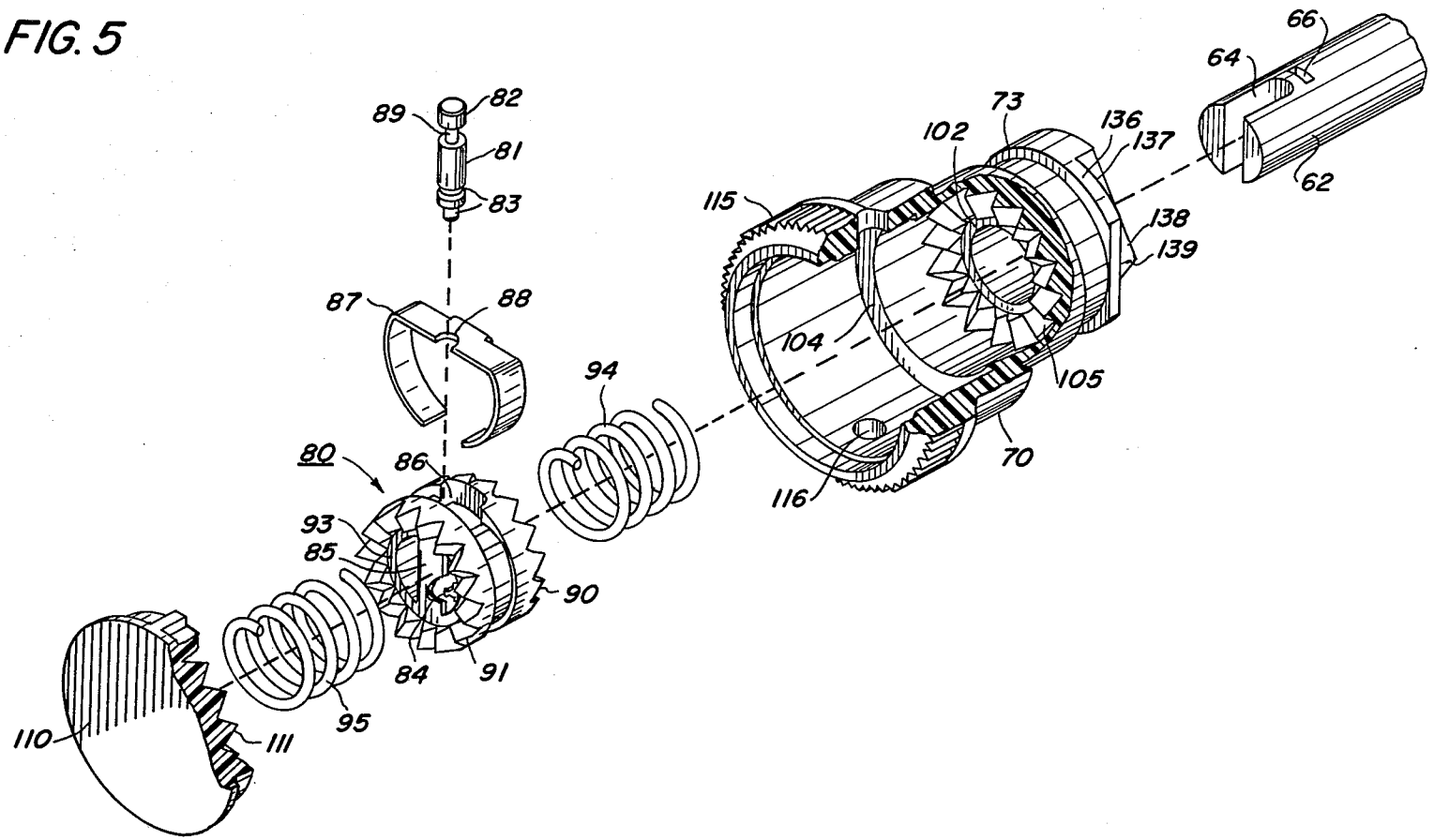
FIG. 5 is an exploded view showing the component parts of the control knob.

It will be understood that the operator's ability to make adjustments of the type described may be withdrawn by reversing the above procedure and returning the pin 81 to the raised blocking position shown in FIGS. 2 and 3. In this instance, the service technician drives pin 81 from the opposite end.

If during service, the service technician desires to remove control knob 65 from shaft 61, following release of lock 131 and sliding of locking plate 74 to a non-interferring position, control knob 65 is depressed to align aperture 116 in sleeve 70 with pin 81. Pin 81 is then forced outwardly against retainer 87 to disengage prong 78 of retainer 87 from recess 66 in shaft 61. Control knob 65 may then be pulled off of shaft 61.

It will be understood that the service module or modules 60 ordinarily provide servicing for a number or all of the machine operating components, and for this purpose may have a plurality of control shafts 61 projecting therefrom. Those control shafts, the access to which is to be limited, are provided with the cooperating control knob/locking plate 65, 74 arrangement heretofore described while other control shafts not similarly restricted may be provided with conventional knobs or other devices facilitating rotational operation thereof.

It is also understood that, in a multiple component service module 60 such as illustrated, the degree of adjustment allowed the machine operator may vary from control shaft to control shaft. This is done by providing predetermined configurations for cam section 137 tailored to each operating component and may vary from unrestricted rotation of control shaft 61 to extremely limited rotation. In addition, cam sections 137 of different predetermined configurations may be substituted from time to time by the service technican such that for any given control knob, operator access may be progressively increased.

While the invention has been described with reference to the structure disclosed, it is not confined to the details set forth, but is intended to cover such modifications or changes as may come within the scope of the following claims.

What is claimed is:

1. The method of operating a reproduction machine having a plurality of discrete operating components cooperable to produce copies, at least one of the operating components being adjustable to permit at least one of the operating parameters thereof to be varied over a range of values, the steps comprising:

presetting said one operating component to a predetermined operating value;

enabling the settings of said one operating component to be varied within preset limits by the machine operator said limits being less than the full range of possible values; and setting a masterlock to prevent unauthorized adjustment of said operating component setting except to the extent permitted.

2. The method of servicing a reproduction machine having a plurality of operating components cooperable to produce copies, said operating components being individually adjustable to enable the operating parameters of said components to be optimized, the steps comprising:

presetting said operating components to individual preselected operating levels to provide desired machine performance;

enabling the setting of at least one of said operating components to be varied within preset limits by the machine operator; and locking said operating components to prevent altering of the operating settings thereof except to the extent permitted.

3. The method of servicing an electrostatic type copier having at least one power supply providing electrical power to an operating component of the copier, together with an adjustable control for regulating the power output of said power supply to said one component and a lock to prevent unauthorized adjustment of the setting of said control, the steps comprising:

unlocking the lock to free said control so that the power output of said power supply to said one operating component can be reset;

while unlocked, placing the lock in a partial released position permitting the copier operator to make limited adjustments of said control whereby to vary the power output to said one component; and relocking the lock.

4. In an electrostatic type reproduction machine having plural operating components, the combination of:

adjusting means associated with each of said machine operating components to enable the working settings of each component to be changed when servicing the machine for optimum machine performance, at least one of said individual adjusting means including reset control means adapted when actuated to permit the setting of the component associated therewith to be changed to a limited extent by the machine operator between machine servicing intervals; and master lock means effective when set to prevent unauthorized actuation of said component adjusting means and changing of the component setting except to said limited extent permitted by actuation of said reset control means.

5. In an electrostatic type reproduction machine having plural operating components, the combination of:

adjusting means associated with each of said machine operating components to enable the working settings of each component to be changed when servicing the machine for optimum machine performance, at least one of said individual adjusting means including reset control means adapted when actuated to permit the setting of the component associated therewith to be changed to a limited extent by the machine operator between machine servicing intervals; and master lock means effective when set to prevent unauthorized actuation of said component adjusting means and changing of the component settings except as permitted by actuation of said reset control means, said reset control means including means to restrict the changes in setting of said component by the machine operator to a predetermined maximum.

* * * * *